US005576722A

United States Patent [19]

Bustillos

[11] Patent Number: 5,576,722

[45] Date of Patent: Nov. 19, 1996

[54] MOBILE SATELLITE ANTENNA BASE AND ALIGNMENT APPARATUS

[75] Inventor: Manuel D. Bustillos, ElPaso, Tex.

[73] Assignee: The United States of America as represented by the Secretary of the Army, Washington, D.C.

[21] Appl. No.: 305,230

[22] Filed: Sep. 13, 1994

[51] Int. Cl.[6] ..... H01Q 3/02

[52] U.S. Cl. ..... 343/882; 343/880; 343/881; 248/170; 248/179.1

[58] Field of Search ..... 343/882, 878, 343/757, 880, 881; 248/170, 171, 188.7, 183, 179; H01Q 3/02

[56] References Cited

U.S. PATENT DOCUMENTS

| | | | |
|---|---|---|---|
| 4,061,302 | 12/1977 | Boone | 248/170 |
| 4,208,946 | 6/1980 | Van Sickle | 248/179 |
| 4,644,365 | 2/1987 | Horning | 343/882 |
| 4,652,890 | 3/1987 | Crean | 343/882 |
| 4,800,394 | 1/1989 | Homann et al. | 343/882 |
| 4,875,052 | 10/1989 | Anderson et al. | 343/882 |
| 5,056,745 | 10/1991 | Gelbard | 248/183 |
| 5,198,830 | 3/1993 | Lin | 343/882 |

*Primary Examiner*—Hoanganh Le
*Attorney, Agent, or Firm*—Freda L. Krosnick; Frank J. Dynda

[57] ABSTRACT

A lightweight yet rugged satellite antenna base and alignment apparatus for use in mobile operations into remote locations having minimal support facilities available. The invention utilizes a base having a vertical mast with adjustable stabilizer legs which may be retracted during transportation. The alignment mechanism comprises an antenna support plate which is pivoted by a pivot screw to provide antenna elevation adjustment, and which is rotated by a worm gear to provide for antenna azimuth adjustment. A bubble level is provided for vertical alignment of the mast.

5 Claims, 6 Drawing Sheets

MOBILE SATELLITE ANTENNA BASE AND ALIGNMENT APPARATUS

TECHNICAL FIELD

This invention relates to satellite antennas, and more particularly to an antenna support apparatus which is mobile and provides for simplified antenna alignment.

BACKGROUND ART

Communication satellites are placed into geosynchronous orbits in which the satellite rotates about the earth at the same rate, and in the same direction, that the earth turns, thus maintaining the satellite above a particular point on the earth. These orbits are in the earth's equatorial plane at approximately 22,300 miles above the earth's surface. Antenna systems for receiving the signals transmitted by these satellites fall into two basic categories: fixed systems and mobile systems. A typical fixed antenna system is that used for receiving satellite television transmissions in one's home. A typical mobile system is a "satellite truck" used by television stations to relay information from a site remote from the television studio.

If a fixed antenna is to receive signals from only one satellite, then of course it is only necessary to point the antenna at the satellite and secure the antenna in place. If a fixed antenna is to receive signals from more than one satellite, the antenna is generally rotatable about the polar axis of the system, with the antenna tilted and fixed with respect to the polar axis at the proper declination angle. Mobile antennas, which must be repositioned both in azimuth and in elevation for different locations on the earth's surface, generally employ computer controlled servomechanisms which drive the antenna in response to inputs of antenna location and satellite location.

DISCLOSURE OF THE INVENTION

The present invention discloses a lightweight yet rugged satellite antenna base and alignment apparatus for use in mobile operations into remote locations having minimal support facilities available. The invention utilizes a base having a vertical mast with adjustable stabilizer legs which may be retracted during transportation. The alignment mechanism comprises an antenna support plate which is pivoted by means of a pivot screw to provide antenna elevation adjustment, and which is rotated by means of a worm gear to provide for antenna azimuth adjustment. A bubble level is provided for vertical alignment of the mast.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
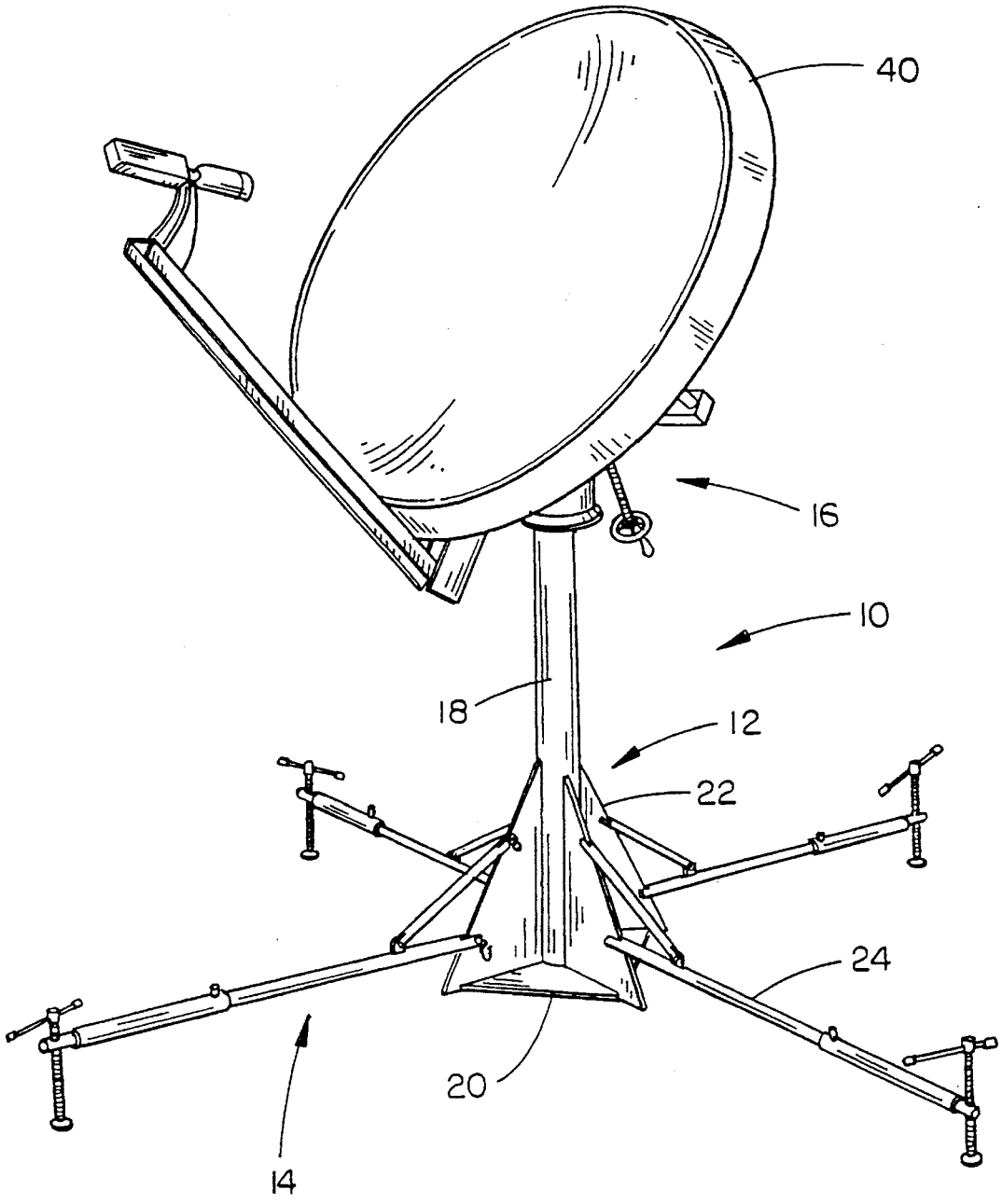
FIG. 1 is a perspective view of the invention.
Figure 2:
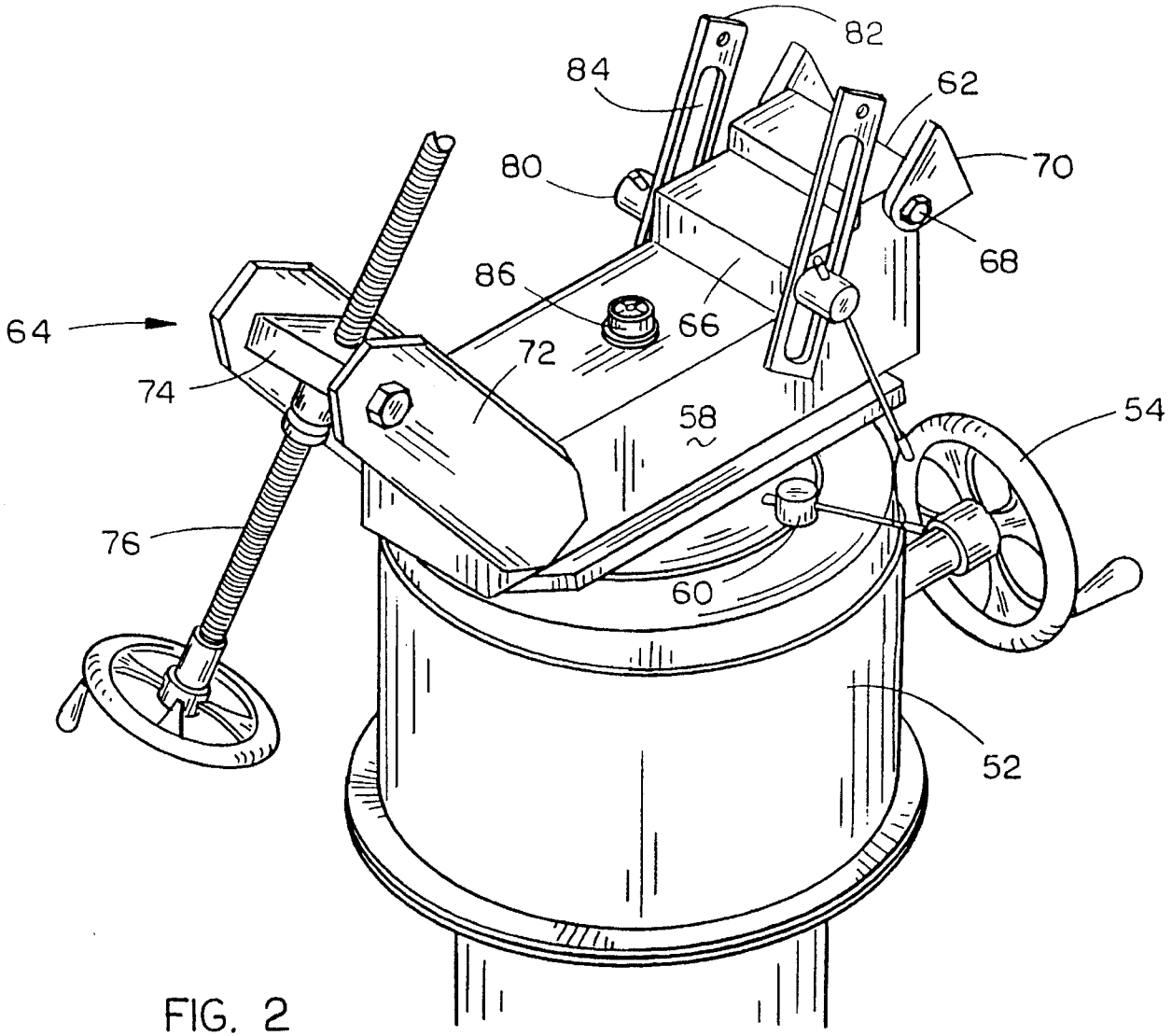
FIG. 2 is a close-up perspective view of the azimuth and elevation alignment mechanisms.

Referring now to the drawings, wherein like reference numerals designate identical or corresponding pads throughout the several views, the invention is shown at 10 in FIG. 1 and can be seen to be comprised of three basic components: a vertical mast structure 12, four stabilizer legs 14, and an alignment mechanism 16.

Figure 5:
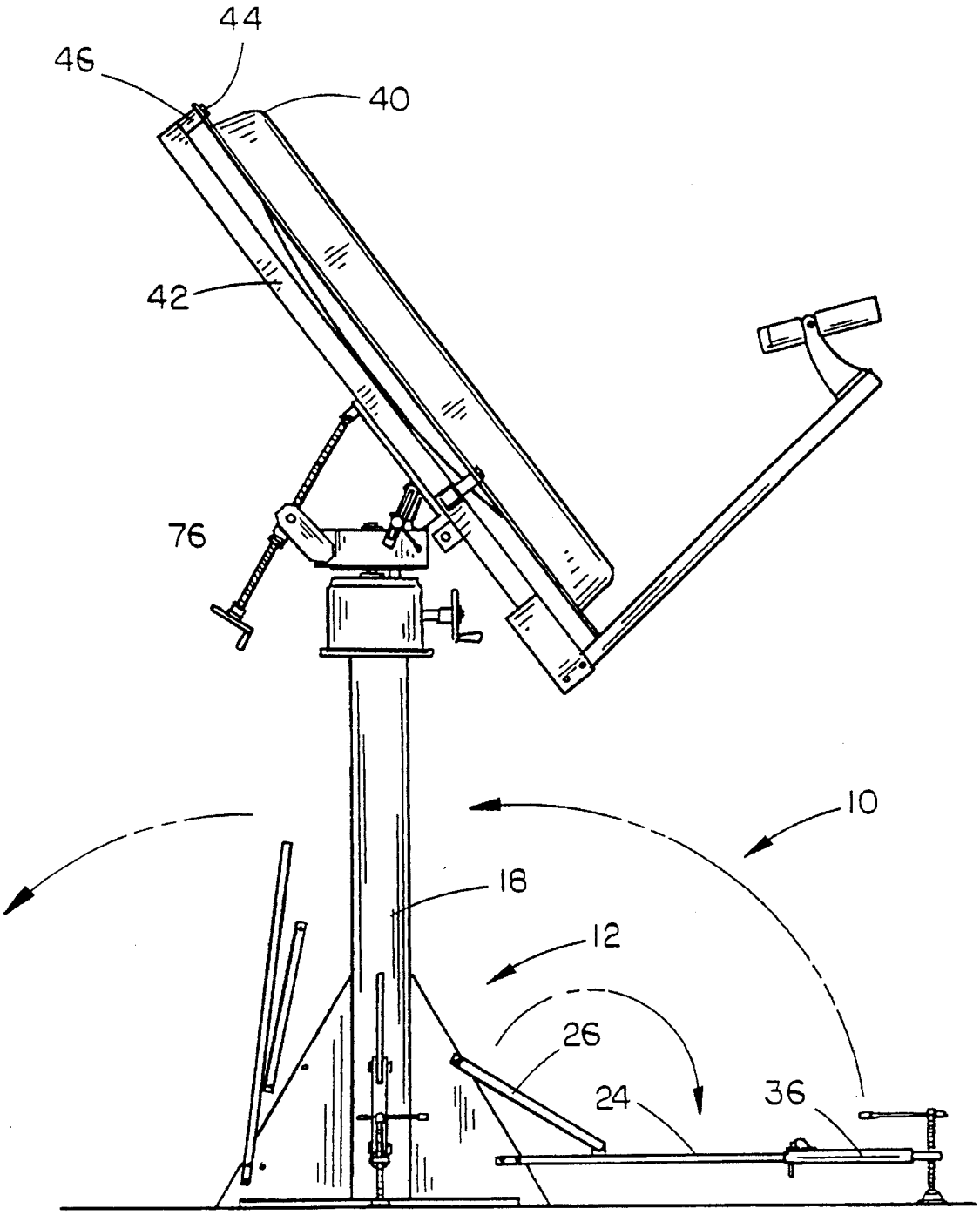
FIG. 5 is a side elevation view of the invention showing how the stabilizer legs may be retracted during transportation.
Figure 6:
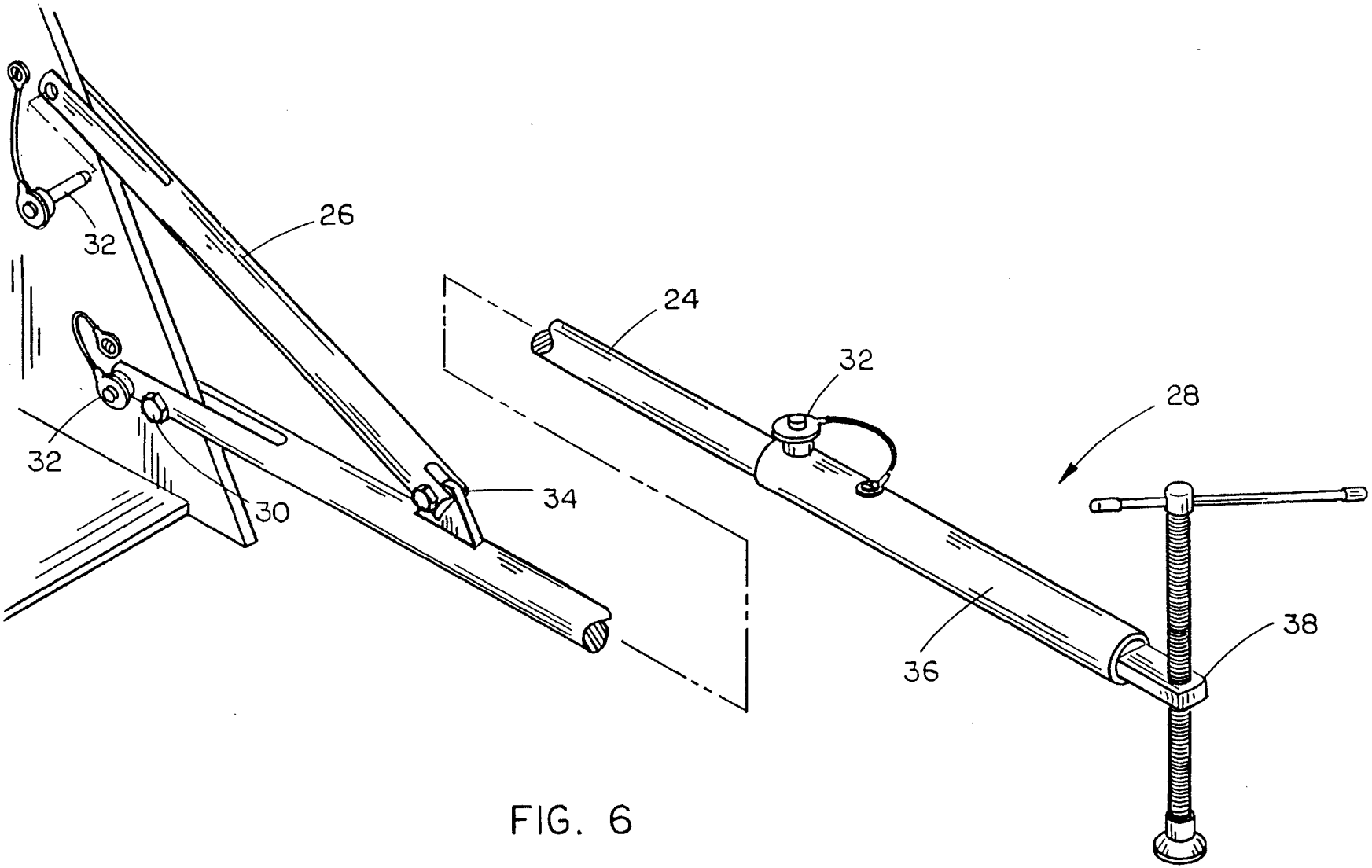
FIG. 6 is a close up view of the stabilizer legs.

The support mast 12 is preferably fabricated from aluminum and is comprised of a three inch tube 18 approximately thirty six inches long with a base welded to the lower end having a base plate 20 and four triangular braces 22. Referring also to FIGS. 5 and 6, the stabilizer legs 14 are more clearly depicted, and it can be seen that they are comprised of a rod 24, brace 26, and detachable leveler 28. Each rod 24 is secured to a triangular brace 22 by means of a bolt 30 and lock pin 32 Each rod 24 is stabilized by a brace 26, secured to the triangular brace 22 by a lock pin 32 and to the rod 24 by means of flange and bolt assembly 34. As seen in FIG. 5, when the two lock pins 32 are removed, the stabilizer legs 14 may be pivoted adjacent the mast 12 for convenient transportation. The distal end of each rod 24 is fitted with a removable leveler 28 comprised of a short tube 36 and a screw foot 38 attached by means of a lock pin 32. As is obvious from the Figures, each leveler 28 may be adjusted in order to level and stabilize the entire structure and may be removed from the rod 24 during transportation of the apparatus.

Figure 3:
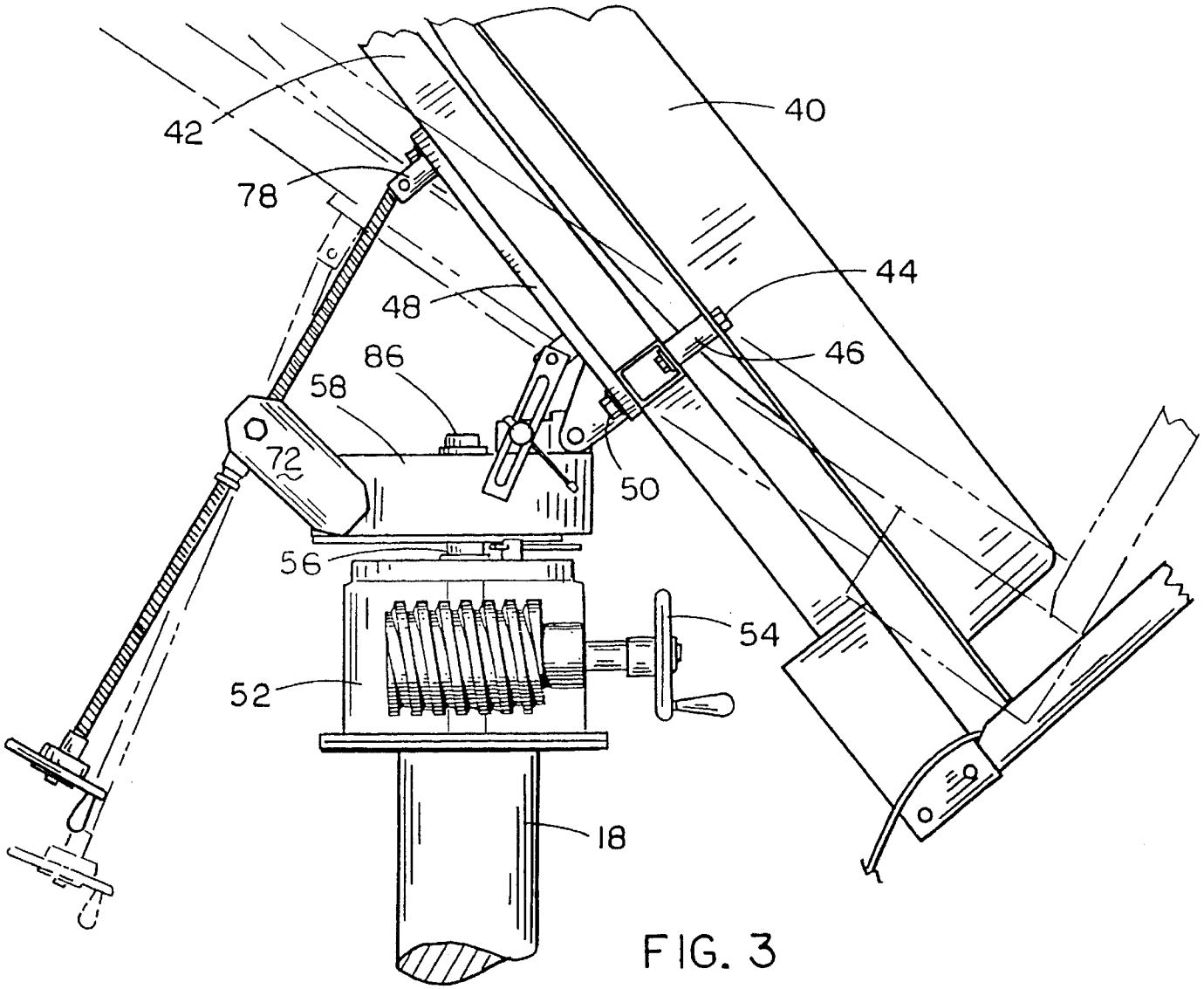
FIG. 3 is a side elevation view of the alignment mechanism and depicts two elevation settings.
Figure 4:
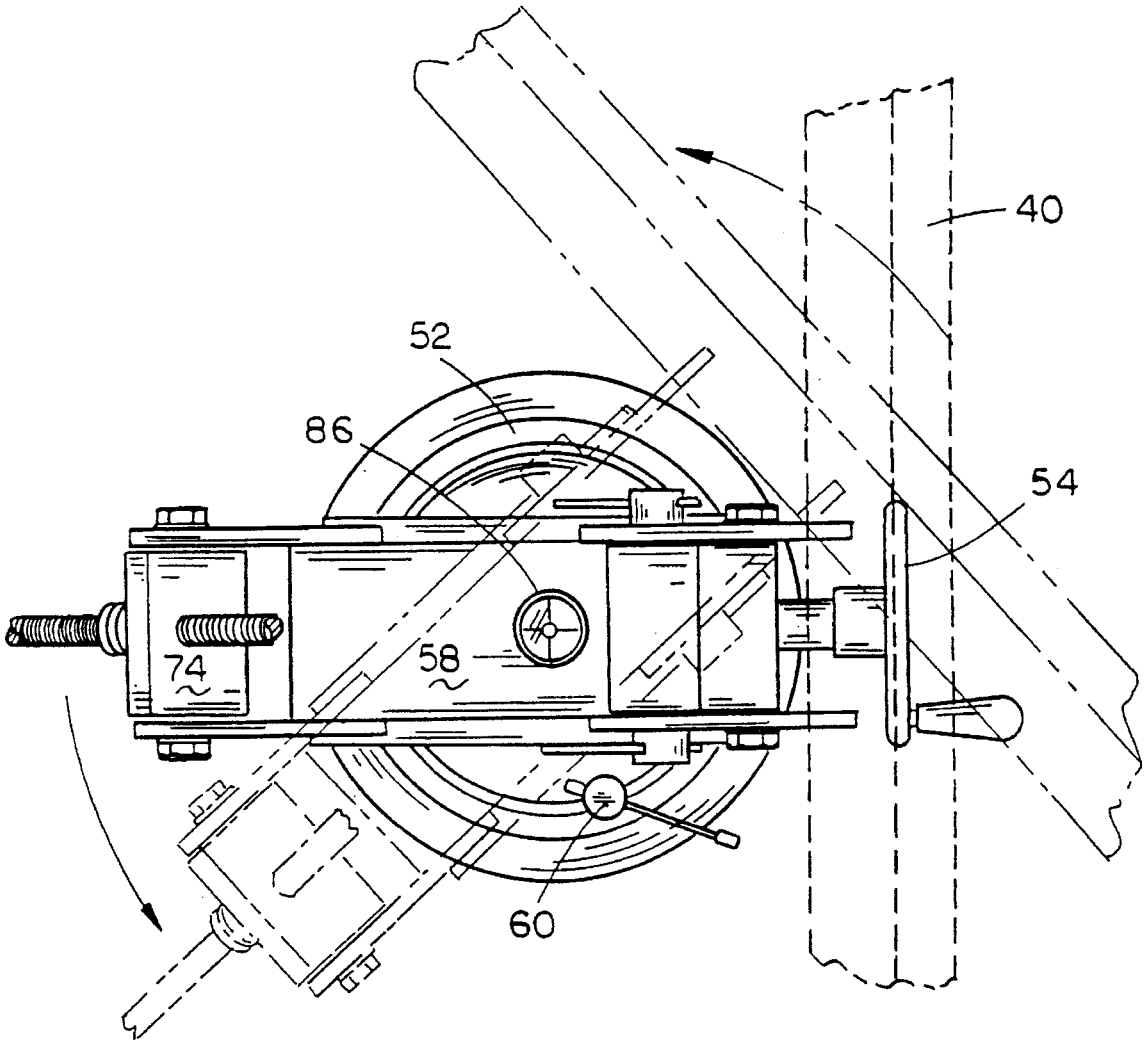
FIG. 4 is a top plan view of the alignment mechanism and depicts two azimuth settings.

Best seen in FIGS. 3 and 5, the dish antenna 40 is attached to an aluminum cross 42 by means of three bolts 44, each of which extends through a rubber mount 46. The aluminum cross is then secured to an elevation plate 48 by means of three bolts 50.

Affixed to the upper end of the mast structure 12 is the antenna alignment mechanism 16, which is basically comprised of an azimuth adjustment mechanism and an elevation adjustment mechanism. The azimuth adjustment mechanism is comprised of a worm gear unit 52, well known in the art, which is affixed, as by welding, to the upper end of the mast 18. The worm gear unit 52 has a drive wheel 54 which, when turned, rotates a vertical drive shaft 56, to which is secured a beam 58. The azimuth adjustment mechanism also includes an azimuth lock 60, which when screwed down will prevent further rotation of the vertical drive shaft 56.

The elevation adjustment mechanism is affixed to the beam 58, and comprises the aforementioned elevation plate 48, a pivot mount 62, a pivot drive screw mechanism 64, and an elevation lock 66. The pivot mount 62 is an aluminum block welded to the upper surface of the beam 58 with a bore for carrying a bolt 68 which receives a pair of flanges 70 extending from the elevation plate 48. The pivot drive screw mechanism 64 comprises a pair of flanges 72 extending from the beam 58 at approximately a 45 degree angle, which carry a rotatable screw block 74. The screw block 74 carries an elongate drive screw 76 which is pivotally attached by means of a ball joint mechanism 78 to the upper end of the elevation plate 48. The elevation lock 66 comprises an aluminum block welded to the upper surface of the beam 58 and has a lock bolt 80 threaded into each end thereof. Each lock bolt 80 receives an elongate flange 82 with a slot 84 which is pivotally attached to the elevation plate 48. Tightening the lock bolts 80 against the flanges 82 will prevent further movement of the elevation plate 48.

Also affixed to the upper surface of the beam 58 is a bubble level 86 to aid in aligning the mast 12 to the vertical.

Obviously, many modifications and variations of the present invention are possible in light of the above teachings. It is therefore to be understood that, within the scope of the appended claims, the invention may be practiced otherwise than as specifically described.

What is claimed is:

1. A satellite antenna base and alignment apparatus, comprising:

a vertical support mast having a lower end and an upper end;

a plurality of adjustable stabilizer legs pivotally attached to said lower end of said mast;

means, affixed to said upper end of said means, for adjusting the azimuth of an antenna;

means, mounted on said azimuth adjusting means, for adjusting the elevation of said antenna; and means for aligning said mast vertically wherein each of said adjustable stabilizer legs comprises a detachable leveler having a screw foot, a rod, a brace, said brace comprising two ends, one end of which is pivotably and removably attached to a triangular brace rigidly attached to said lower end of said support mast and wherein the other end of said brace is pivotably attached to said rod, and wherein said detachable leveler further comprises a short tube and said screw foot wherein said short tube is attached to said rod with a lock pin.

2. The apparatus as recited in claim 1 wherein said azimuth adjusting means comprises a worm gear.

3. The apparatus as recited in claim 2 wherein said elevation adjusting means comprises an elevation plate, pivotally attached to said azimuth adjusting means, and a screw drive for pivoting said elevation plate.

4. The apparatus as recited in claim 3 further comprising an azimuth lock and an elevation lock.

5. The apparatus as recited in claim 4 wherein said vertical aligning means comprises a bubble level.

* * * * *